US007931495B2

(12) United States Patent
Zhu

(10) Patent No.: US 7,931,495 B2
(45) Date of Patent: Apr. 26, 2011

(54) STACKED CONNECTORS HAVING LOWER CONNECTOR FLOATABLY ASSEMBLED THERETO

(75) Inventor: Jian-Kuang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/723,698

(22) Filed: Mar. 15, 2010

(65) Prior Publication Data

US 2010/0233894 A1 Sep. 16, 2010

(30) Foreign Application Priority Data

Mar. 13, 2009 (CN) ..... 2009 2 0301244

(51) Int. Cl.
*H01R 13/60* (2006.01)

(52) U.S. Cl. ..... 439/541.5; 439/64; 439/325

(58) Field of Classification Search ..... 439/541.5, 439/64, 79, 325
See application file for complete search history.

(56) References Cited

U.S. PATENT DOCUMENTS

| | | | | |
|---|---|---|---|---|
| 6,126,472 | A | 10/2000 | Choy | |
| 2001/0029127 | A1* | 10/2001 | Higuchi | 439/541.5 |
| 2004/0023553 | A1* | 2/2004 | Lee | 439/541.5 |
| 2004/0029438 | A1* | 2/2004 | Choy | 439/541.5 |
| 2008/0261416 | A1* | 10/2008 | Ting | 439/64 |
| 2009/0291581 | A1* | 11/2009 | Zhu et al. | 439/325 |

* cited by examiner

*Primary Examiner* — Hien Vu
(74) *Attorney, Agent, or Firm* — Andrew C. Cheng; Wei Te Chung; Ming Chieh Chang

(57) ABSTRACT

A card edge connector assembly for connecting a pair of electrical cards to a printed circuit board includes an upper connector and a lower connector. The upper connector includes a first housing defining a first elongated mating groove along a longitudinal direction with a plurality of first contacts by two sides thereof, and a recess is defined under the first elongated mating groove. The lower connector is moveably received within said recess and includes a second housing defining a second elongated mating groove with a plurality of second contacts by two sides thereof. A metallic member is attached to the upper connector for preventing the lower connector releasing from said recess.

11 Claims, 7 Drawing Sheets

STACKED CONNECTORS HAVING LOWER CONNECTOR FLOATABLY ASSEMBLED THERETO

BACKGROUND OF THE INVENTION

1. Field of the Invention

The present invention relates to a card edge connector assembly, and more particularly to a stacked card edge connector assembly configured with a first connector, and a second connector floatably attached to the first connector.

2. Description of the Related Art

U.S. Pat. No. 6,126,472 issued to Choy on Oct. 3, 2000 discloses a connector assembly configured to have a lower housing and an upper housing each generally including the basic structure of the typical 50 DIMM connector housing. Each housing defines two rows of passageways on two sides of the central slot in which the corresponding module is received. A plurality of contacts are received within the corresponding passageways wherein the tail of each contact extends downward to be soldered onto the PC board on which the connector assembly is mounted. When high density and high speed transmission become a trend, alignment of those four hundreds more contacts with the corresponding solder pads or through holes become an issue. Obviously, an improved card edge connector assembly is highly desired to overcome the aforementioned problem.

SUMMARY OF THE INVENTION

Accordingly, an object of the present invention is to provide a card edge connector assembly facilitates the tails of the contacts inserting into the corresponding holes on a printed circuit board.

In order to achieve the object set forth, a card edge connector assembly for connecting a pair of electrical cards to a printed circuit board includes an upper connector and a lower connector. The upper connector includes a first housing defining a first elongated mating groove along a longitudinal direction with a plurality of first contacts by two sides thereof, and a recess is defined under the first elongated mating groove. The lower connector is moveably received within said recess and includes a second housing defining a second elongated mating groove with a plurality of second contacts by two sides thereof. A metallic member is attached to the upper connector for preventing the lower connector releasing from said recess.

Other objects, advantages and novel features of the invention will become more apparent from the following detailed description of the present embodiment when taken in conjunction with the accompanying drawings.

DETAILED DESCRIPTION OF THE INVENTION

Figure 1:
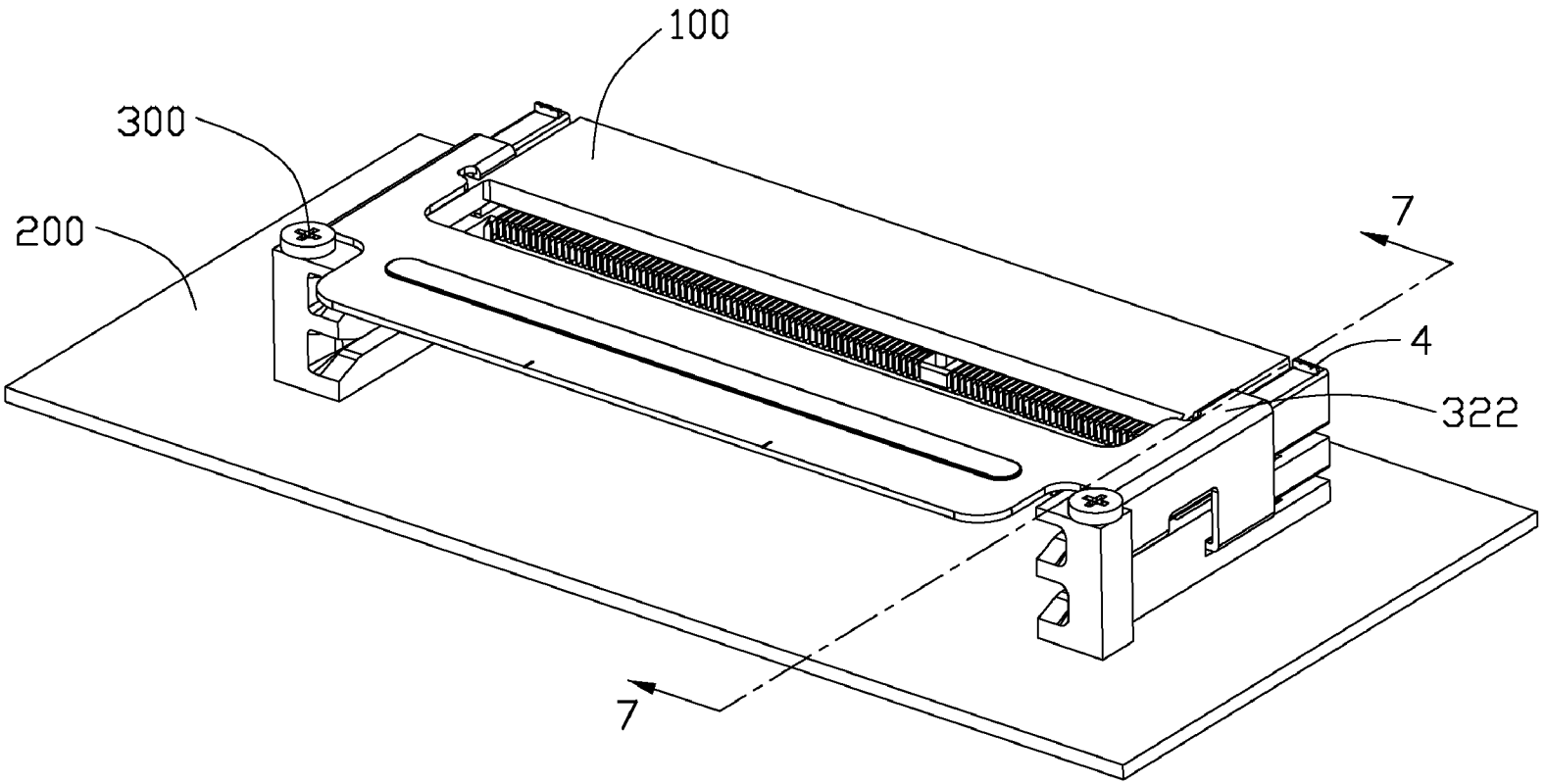
FIG. 1 is a perspective view of a card edge connector assembly in accordance with the present invention mounted on a printed circuit board.
Figure 2:
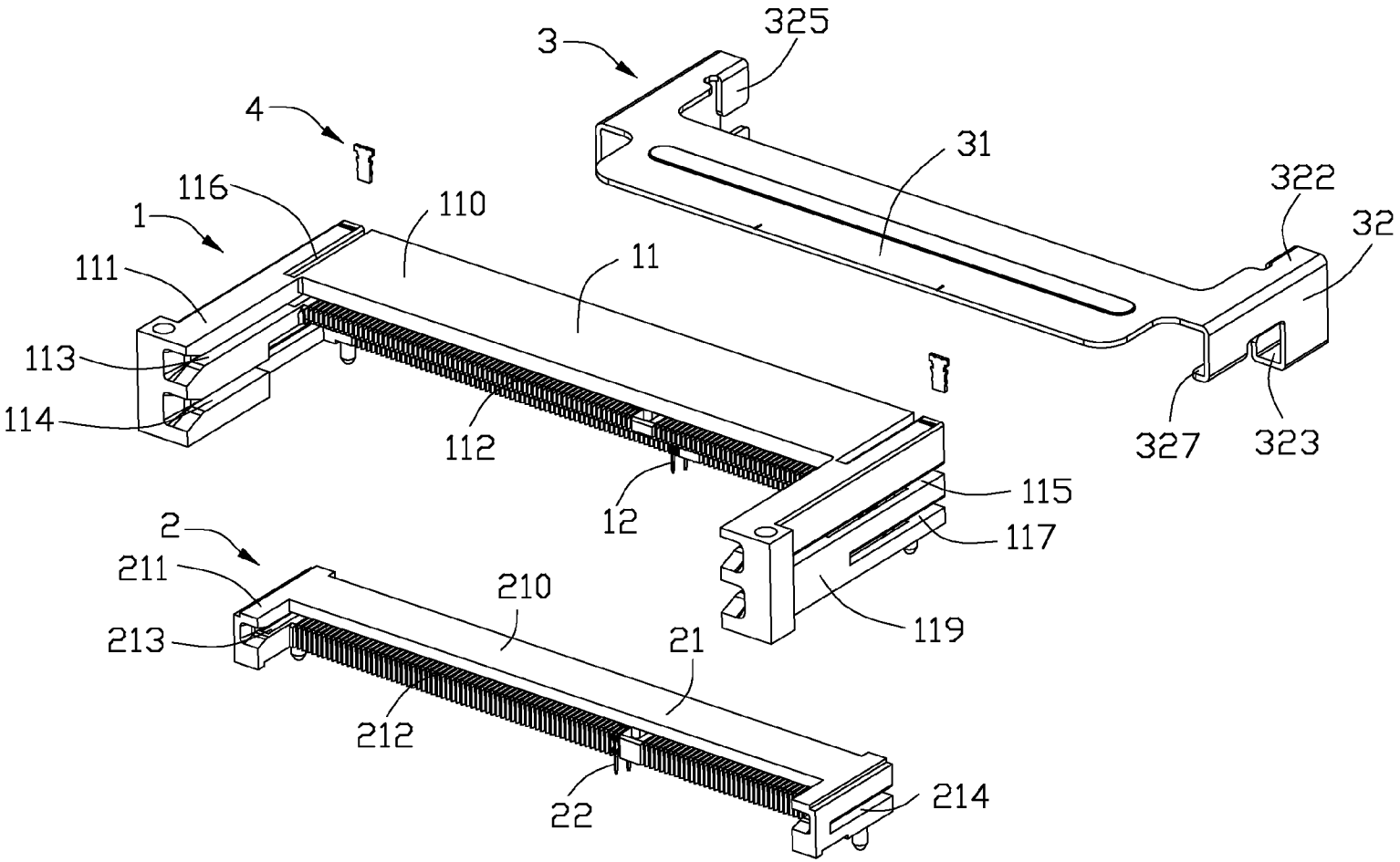
FIG. 2 is an exploded perspective view of the card edge connector assembly shown in FIG. 1.

Reference will now be made to the drawing figures to describe a preferred embodiment of the present invention in detail. Referring to FIGS. 1 and 2, a card edge connector assembly 100 made according to the preferred embodiment of the present invention is provided and comprises an upper connector 1 and a lower connector 2 for respectively connecting a pair of memory modules to a printed circuit board 200 and an ejecting device 3 combining the upper and lower connectors 1, 2 together.

Figure 3:
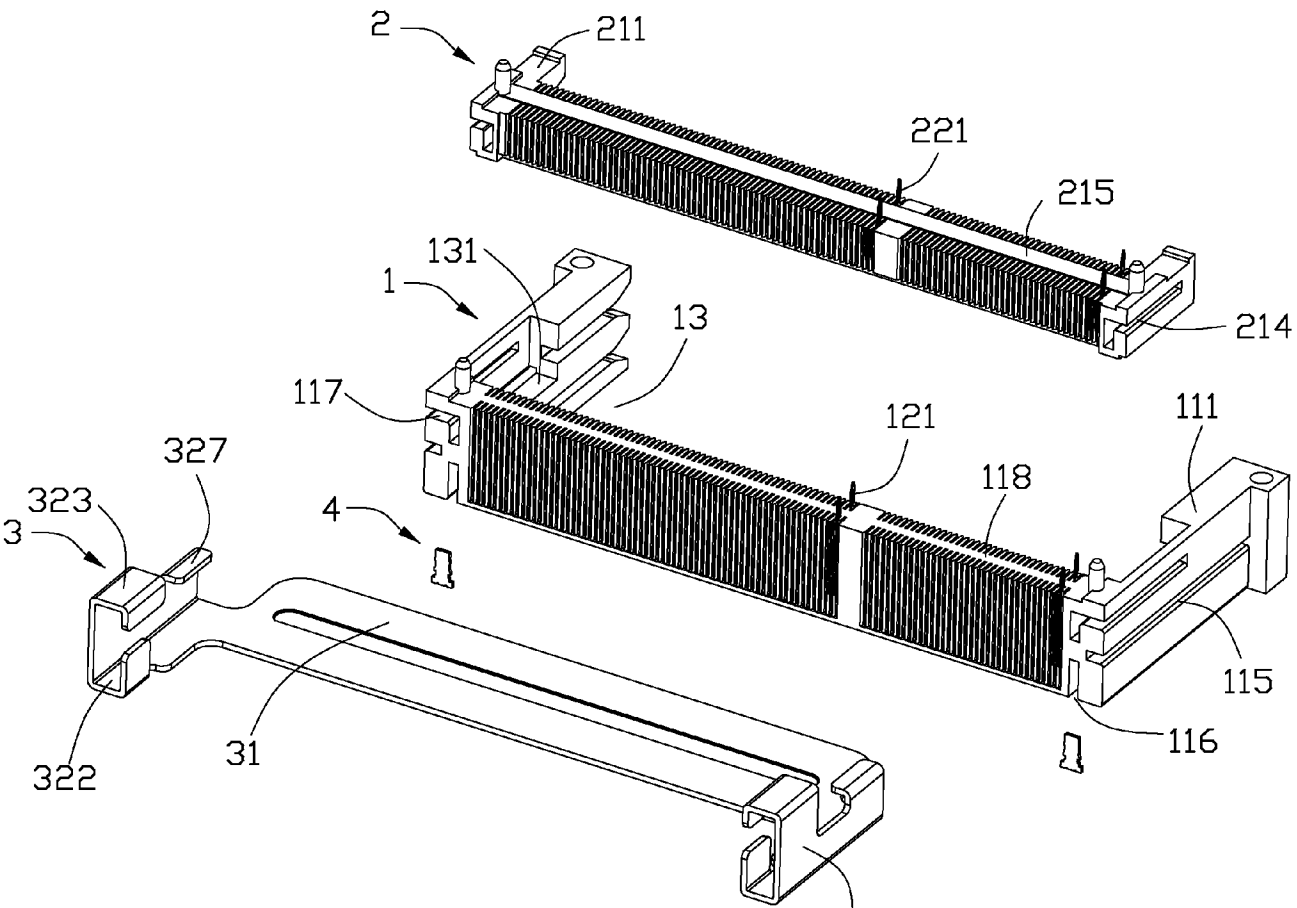
FIG. 3 is another exploded perspective view of the card edge connector assembly shown in FIG. 1.

Referring to FIGS. 2 and 3, the upper connector 1 comprises a first housing 11 and a plurality of first terminals 12 mounted therein. The first housing 11 comprises an elongated first base portion 110 defining a first mating groove 112 extending along a longitudinal direction thereof and a pair of first side arms 111 disposed at opposite ends of the first base portion 110. Each first side arm 111 defines a first and a second guiding grooves 113, 114 parallel to each other at an inner face thereof, and the first guiding groove 113 is coplanar to the first mating groove 112 and in communication with the first mating groove 112 so as to allow the memory module to be inserted in a horizontal manner. In addition, an opening slot 115 extends forwardly and horizontally from a rear middle portion of an outer face 119 of the first side arm 111 along a rear-to-front direction. A first sliding groove 116 runs through a top face of the first base portion 110 along a vertical direction and extends forward from the rear end of the first side arm 111, more particularly, the first sliding groove 116 is in communication with the first mating groove 112 through an aperture defined in the first guiding groove 113. A second sliding groove 117 which is configured as an L-shaped configuration as seen from a rear side thereof and extends forward from the rear end of the first side arm 111. Moreover, the first housing 11 defines a recess portion 13 under the first mating groove 112 thereby making the first housing 11 in an L-shaped configuration. A cut out portion 131 is defined at an inner end of the first side arm 111 so as to broaden the recess portion 13 in the longitudinal direction. Each first terminal 12 defines a solder tail 121 extending out of a mounting face 118 of the first housing 11 and located behind the recess portion 13.

Figure 4:
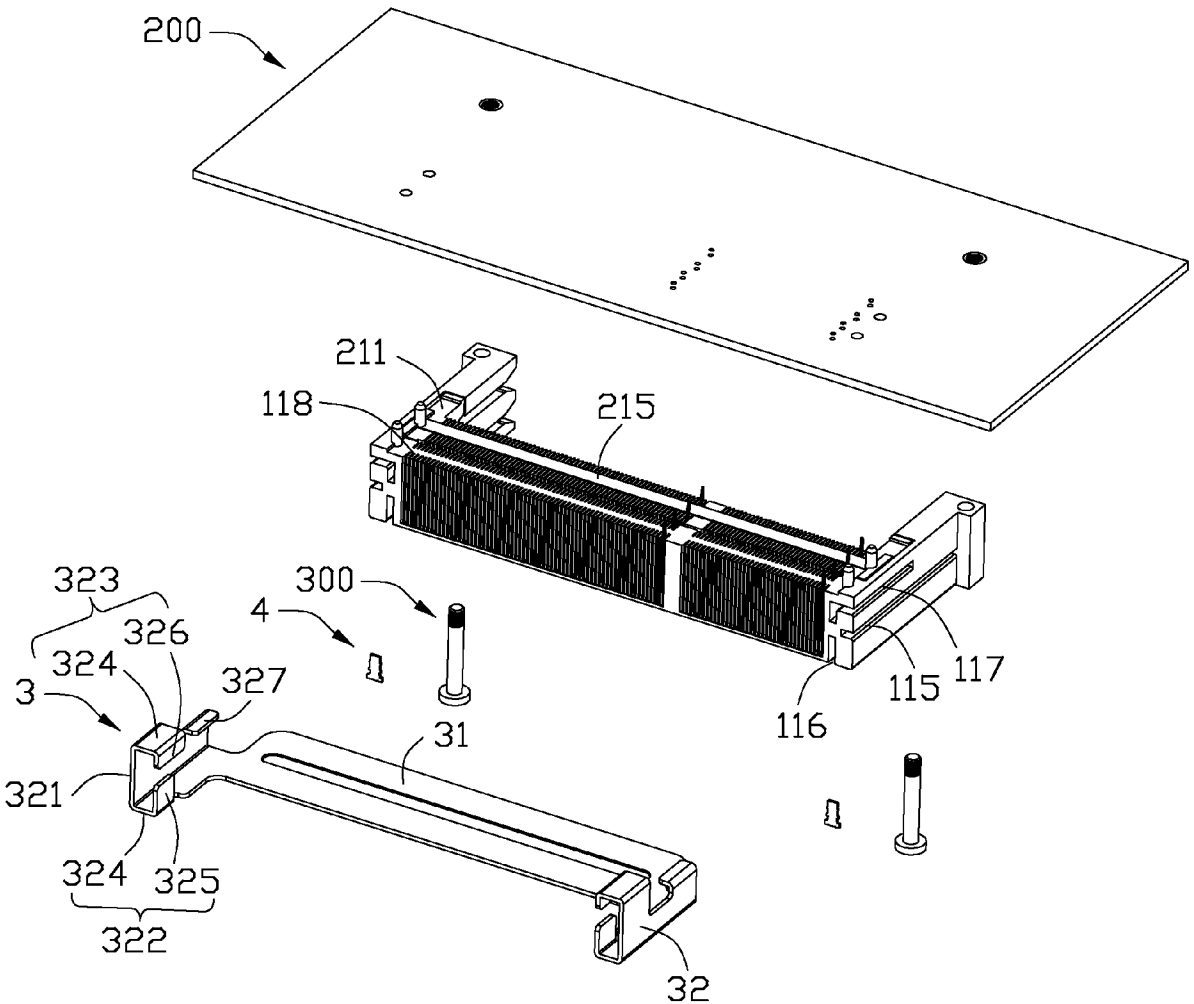
FIG. 4 is an exploded perspective view of the card edge connector assembly shown in FIG. 1, which shows a retaining member releasing from the card edge connector assembly.

Referring to FIG. 2 to FIG. 4, the lower connector 2 comprises a second housing 21 with a plurality of second terminals 22 mounted therein. The second housing 21 comprises an elongated second base portion 210 defining a second mating groove 212 extending along a longitudinal direction thereof and a pair of second side arms 211 disposed at opposite ends of the second base portion 210. A third guiding groove 213 is defined at an inner face of the second side arm 211 and runs toward the second mating groove 212. Moreover, a third sliding groove 214, which is in an L-shaped configuration as seen from the rear side, extends forward from a rear end of the second side arm 211 and is in communication with the second mating groove 212. Each of the second terminals 22 defines a solder tail 221 extending out of a mounting face 215 of the second housing 21.

Figure 7:
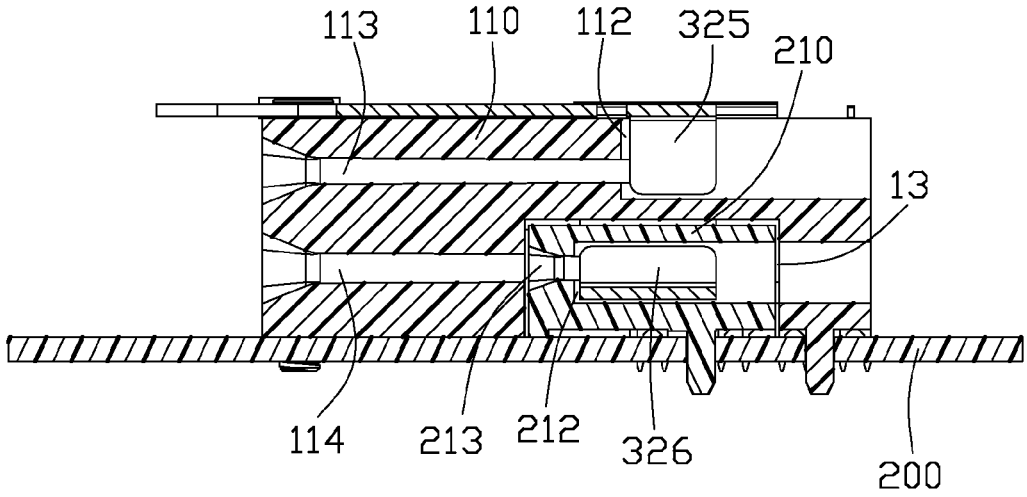
FIG. 7 is a cross sectional view of the card edge connector assembly shown in FIG. 1 along line 7-7

Referring to FIGS. 3, 4 and 7, the lower connector 2 is inserted into the recess portion 13 from the mounting face 118 with the second side arms 211 received in the cut out portion 131, and the front ends of upper and lower connectors 1, 2 are aligned with each other in the vertical direction. The third sliding groove 214 is located at an inner side of the second sliding groove 117 and communicates with the second sliding groove 117 in a horizontal plane. Meanwhile, the third guiding groove 213 is located behind the second guiding groove 114 and connects with the second guiding groove 114 in the rear-to-front direction. The dimension of the recess portion 13 is slightly larger than that of the lower connector 2, therefore apertures are defined between the lower connector 2 and the upper connector 1 which allow the lower connector 2 to slightly move toward any direction.

Referring to FIGS. 2-4, the ejecting device 3 is made by stamping a metal sheet and comprises a plate like operating portion 31 and a pair of side portions 32 symmetrically arranged at opposite ends of the operating portion 31. Each side portion 32 comprises a side plate 321 extending forward from the operating portion 31 and perpendicular to the operating portion 31, and a first and a second positioning portion 322, 323 respectively extending from an upper and a lower edge of the side plate 321. The first and second positioning portions 322, 323 are away from the operating portion 31 and respectively comprise a horizontal plate 324 and a vertical plate 325/326 which are configured as an L-shaped. A guiding plate 327 is defined at the upper edge of the side plate 321 and located adjacent to the operating portion 31.

Figure 5:
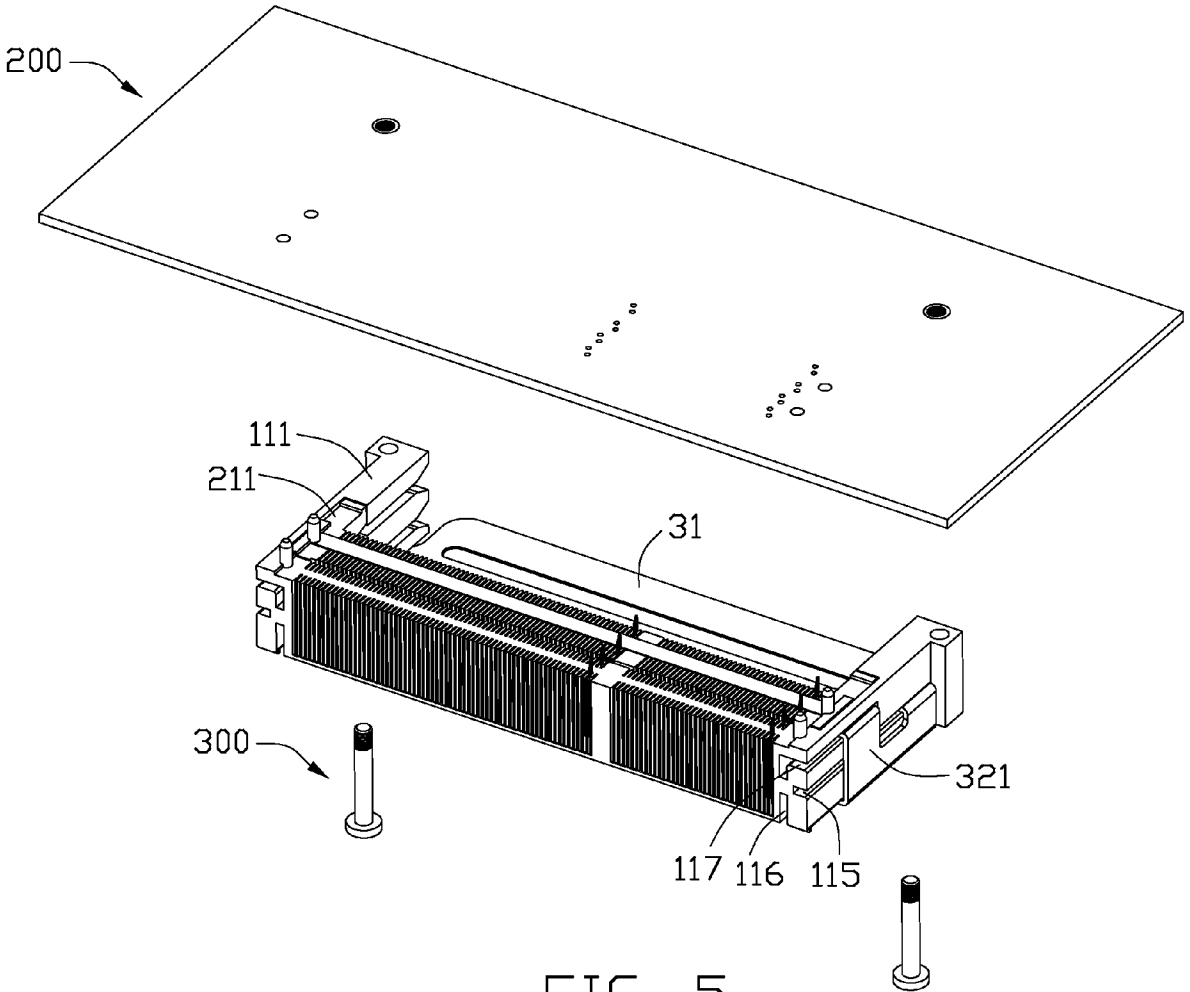
FIG. 5 is a perspective view of the card edge connector assembly shown in FIG. 1, seen from a bottom side.
Figure 6:
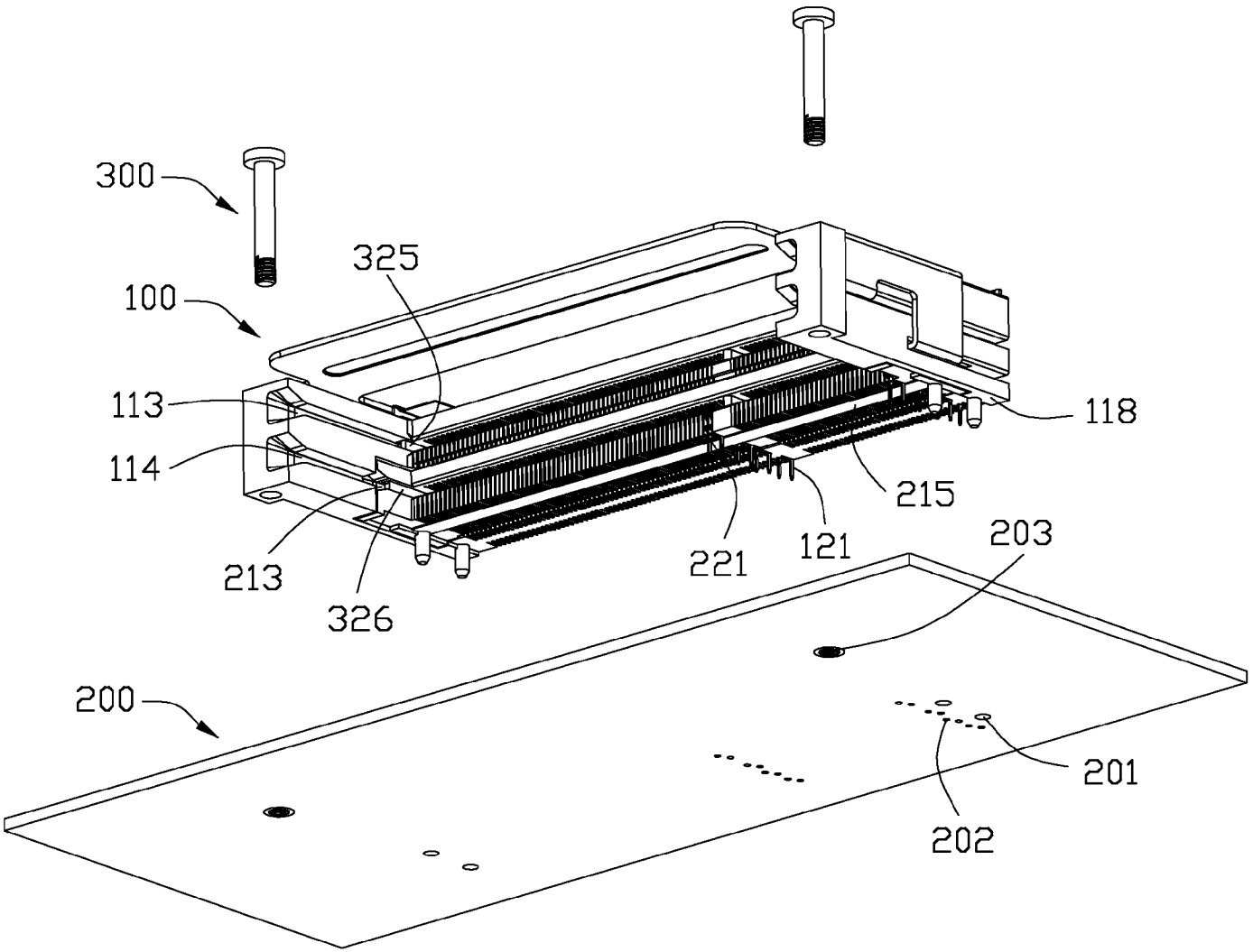
FIG. 6 is a perspective view of the card edge connector assembly shown in FIG. 1, seen from a front side.

Referring to FIG. 5-7, the ejecting device 3 is assembled onto the first connector 2 from a rear end thereof, the guiding plate 327 is firstly inserted into the opening slot 115, then the vertical plate 325 of the first positioning portion 322 is inserted into the first sliding groove 116 with the horizontal plate 324 covering a top face of the first side arm 111, meanwhile the second positioning portion 323 is inserted into the second sliding groove 117. Finally, a pair of bars 4 are respectively inserted into the rear end of the first side arm 111 for preventing the ejecting device 3 releasing from the first connector 2. As the second positioning portion 323 is longer than the second sliding groove 117, an end portion of the second positioning portion 323 projects into the third sliding groove 214, which will prevent the downward movement of the lower connector 2 and combine the upper connector 1 and the lower connector 2 together. In addition, robust space is defined between the third sliding grooves 214 and the second positioning portion 323, which will allow the lower connector 2 to move in a predetermined range with regard to the upper connector 1. The vertical plate 325/326 acts as an ejecting portion when pushing the memory module out of the mating cavity 112/212 by pulling the operating portion 31.

Referring to FIGS. 1 and 6, aligning posts defined on the upper and lower connectors 1, 2 are firstly inserted into the positioning hole 201 on the printed circuit board 200, then the solder tails 121, 221 of the first and second terminals 12, 22 are inserted into the corresponding holes 202 on the printed circuit board 200 with the help of the aligning posts. As the lower connector 2 can move within a predetermined range, the solder tails 221 have a little room to be inserted into the corresponding holes 202 correctly and easily. Finally, a pair of nuts are provided to fasten the card edge connector assembly 100 onto corresponding screws 203 on the printed circuit board 200.

In the present invention, the solder tails 121 of the first terminals 12 have an independent positioning plane from the solder tails 221 of the second terminals 22, therefore the two groups of solder tails 121, 221 can separately be inserted into the corresponding holes 202, which will reduce the difficulty of the soldering process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector assembly for connecting a pair of electrical cards to a printed circuit board comprising:

a first connector and a second connector;

said first connector including a first insulative housing defining a first elongated receiving slot which defines a longitudinal direction and is equipped with a plurality of first contacts by two sides thereof, each first contact having a solder tail protruding out of a first mounting face defined by the first connector;

said second connector including a second insulative housing defining a second elongated slot with a plurality of second contacts by two sides thereof, each second contact having a solder tail protruding out of a second mounting face defined by the second connector;

a connecting device, interconnecting the first and second connectors together; wherein the second mounting face of the second connector is moveable relative to the first mounting face of the first connector;

wherein the first and the second contacts of the first and second connectors only allow said electrical cards to be inserted into the corresponding elongated slot in a horizontal manner;

wherein said connecting device has a pair of positioning portions disposed at longitudinal ends of the first and second insulative housings for interconnecting the first and second insulative housings together; and wherein sliding grooves are defined on the first and second insulative housings for receiving said positioning portions, while the dimension of the sliding grooves is larger than that of the positioning portions so as to allow the second insulative housing to move relative to the first insulative housing.

2. The card edge connector assembly as described in claim 1, wherein said connecting device has an elongated operating portion disposed in front of the first and second insulative housings, and each of said positioning portions is partly projecting into the first and second elongated slots for ejecting said electrical cards.

3. The card edge connector assembly as described in claim 1, wherein each of said sliding grooves is in an L-shaped configuration seen from a rear side.

4. A card edge connector assembly comprising:

an upper connector and a lower connector;

said upper connector including a first housing defining a first elongated mating groove along a longitudinal direction with a plurality of first contacts by two sides thereof, a recess being defined under the first elongated mating groove;

said lower connector being moveably received within said recess and including a second housing defining a second elongated mating groove with a plurality of second contacts by two sides thereof; and a metallic member, attached to the upper connector for preventing the lower connector releasing from said recess;

wherein the dimension of the recess is slightly larger than that of the lower connector;

wherein the first housing defines a pair of arms at longitudinal ends thereof, each arm defines a cut out portion adjacent to the first elongated mating groove so as to broaden the recess in the longitudinal direction; and wherein each arm defines a pair of guiding grooves parallel to each other and respectively in communication with the first and second mating grooves.

5. The card edge connector assembly as described in claim 4, wherein the metallic member defines a pair of ejecting portions respectively projecting into the first and second mating grooves.

6. The card edge connector assembly as described in claim 4, wherein the upper connector and the lower connector are aligned with each in a vertical direction perpendicular to said longitudinal direction.

7. The card edge connector assembly as described in claim 6, wherein the first and second housings respectively define a first and a second sliding grooves, which are aligned with each other along a rear-to-front direction.

8. A card edge connector assembly comprising:

an upper connector and a lower connector in a vertical direction, the upper connector defining a first insulative housing with an upper card receiving slot and a pair of upper guiding arms which is essentially coplanar with the upper card receiving slot, and a pair of lower guiding arm, a plurality of upper contacts disposed in the first housing and extending into the upper card receiving slot;

the lower connector defining a second insulative housing with a lower card receiving slot which is essentially coplanar with said pair of lower guiding arms; and a recess formed in a lower portion of the first housing to receiving said second housing in a somewhat floating manner;

wherein first housing and said second housing are assembled together by a metallic connecting device which is assembled to both said first housing and said second housing along a mating direction perpendicular to said vertical direction;

wherein said connecting device defines a dimension similar to that of the first housing and the second housing in a transverse direction perpendicular to both said vertical direction and said mating direction; and wherein said connecting device is moveable relative to both said first housing and said second housing, and includes upper and lower projections respectively extending into the upper card receiving slot and the lower card receiving slot, respectively, for removal of corresponding cards in said upper card receiving slot and said lower card receiving slot, respectively.

9. The card edge connector assembly as claimed in claim 8, wherein both said upper projection and said lower projection extend in the vertical direction.

10. The card edge connector assembly as claimed in claim 8 wherein each of said first housing and said second housing is equipped with at least a locating post downwardly extending from a corresponding mounting face for locating the corresponding housing upon a printed circuit board.

11. The card edge connector assembly as claimed in claim 10, further including a securing device to fasten the first housing to said printed circuit board.

* * * * *